United States Patent [19]

Klauba et al.

[11] 4,381,673

[45] May 3, 1983

[54] VIBRATIONAL STRESS RELIEF

[75] Inventors: Bruce Klauba, Princeton, Ill.; Roger Titone, Iowa City, Iowa

[73] Assignee: Martin Engineering Company, Neponset, Ill.

[21] Appl. No.: 212,366

[22] Filed: Dec. 3, 1980

[51] Int. Cl.[3] ..... G01H 13/00; C21D 1/04

[52] U.S. Cl. ..... 73/579; 148/12.9

[58] Field of Search ..... 73/579; 148/12.9

[56] References Cited

U.S. PATENT DOCUMENTS

| | | | |
|---|---|---|---|
| 3,622,404 | 11/1971 | Thompson | 73/579 |
| 3,677,831 | 7/1972 | Pezaris et al. | 148/12.9 |
| 3,741,820 | 6/1973 | Hebel, Jr. et al. | 148/12.9 |

*Primary Examiner*—Stephen A. Kreitman

*Attorney, Agent, or Firm*—McWilliams, Mann & Zummer

[57] ABSTRACT

A method and apparatus for accomplishing stress relief in fabricated structures by application of dynamic loading induced by vibration to relieve residual stresses sufficiently to achieve dimensional stability. Maximum dynamic loading of the structure by use of an accelerometer attached to the structure is obtained by scanning a range of vibration frequencies to arrive at maximum output of the accelerometer corresponding to the maximum in the dynamically applied loading and tuning the vibration to a frequency corresponding to the peak in the acceleration curve.

2 Claims, 3 Drawing Figures

VIBRATIONAL STRESS RELIEF

BACKGROUND OF THE INVENTION

1. Field Of The Invention

This invention relates to the field of stress relieving structures in the metal fabricating industry, such as welded assemblies and more particularly where such relief is obtained by vibration of an assembled structure to arrive at a stable structure substantially free of internal stresses.

2. Description Of The Prior Art

The metalworking industry has experienced considerable difficulty in manufacturing dimensionally accurate heavy industry components such as heavy machine tools, large farm equipment, transportation equipment, construction equipment and various industrial processing machinery, or equipment.

Product quality has improved, but complexity of design has increased and sensitivity to dimensional instability has become correspondingly more acute. One reason for such difficulties in maintaining the dimensional quality has been that the fabrication methods, whether welding, casting, or forging, utilize heat processing of the metal structures. In forming metal it frequently received large quantities of heat to obtain the near molten state required for shaping processes. Such methods produced great temperature differences in the component structures and this causes residual stresses which remained locked in the component structures after the forming or shaping is completed.

It was necessary to reduce or relieve these built-in stresses by loading the completed structures in a complex manner, or by machining, which often removed metal that had at least partially opposed certain of the residual stresses, or by a stress relief treatment such as by annealing the entire component assembly. If machining occurred prior to relieving such residual stresses, warping, twisting, or other dimensional distortion often resulted.

One solution to this problem was the early practice of storing completed workpieces out of doors in all kinds of weather so that the variations in the weather imposed loads, such as those induced by expansion and contraction. This experience often provides sufficient loading and unloading of the workpieces to arrive at some relief of the residual stresses. However, where large fabricated components were involved, the period of stress relief was very extended and might run a year, or two years, or more.

Another method of solving the problem was developed as a means of saving production time and to meet the inventory pressures. This method utilized as an alternative to the storage system, involved a thermal stress relief process in which the fabricated steel component was placed in a furnace and the temperature raised to approximately 1100° F. This temperature was maintained for a period of time that was identified as the soaking period and then it was necessary to resort to a gradual cool down period. While not as lengthy as the storage method, this system also required a considerable period of time to complete properly.

During the process of thermal stress relief, the relation between stress and strain is altered so that the yield point of the material is substantially lowered which allows stresses above the new yield point to cause plastic flow and thereby reduce the level of the residual stresses. This occurs during the soaking period in the thermal stress relief system, but during the cool down the original yield point is re-established with the result that the high level stresses have been reduced and these typically are the residual stresses that interfere with dimensional stability. This method allowed somewhat faster and more consistent processing of dimensionally critical components but like practically all industrial techniques, it had its disadvantages and limitations.

The thermal treatment caused scaling and sagging of the workpiece. This required the extra processing step of removing the scaling before the component could be utilized in production. The heat of the process resulted in the strength of the component being lowered while in the furnace and frequently sagging of the component resulted, frequently because of the very weight of some heavy components which acted in this manner because of their weight. In attempts to avoid this difficulty, braces sometimes were welded across the sag lines, but again this caused additional labor and material expense.

Frequently, metallurgical changes occurred in a component that altered the physical characteristics of the material and which was usually negative. A number of metals react in this manner.

The energy requirements of the thermal process, especially where a large furnace must be utilized for very large components, is enormous and where heavy wall thicknesses are utilized in the plate structures of the components a greater period of treatment is necessitated with consequently greater cool down time, all of which contribute greatly to the expense of this system.

A prior art method of stress relieving a work piece by vibration is disclosed in U.S. Pat. No. 3,622,404, but this method required vibration of a workpiece in the frequency range of the resonant peak for each part of the piece to be relieved and maintaining the vibration in the frequency range of each such peak while the amplitude of the peak increases and the power to produce the peak decreases while the frequency range decreases until the power producing the amplitude has stabilized.

However, the acceleration data was distorted because the accelerometer developed resonance within the range under study. Also, poor filtering in the control console affected the acceleration signal and the acceleration data was not completely, or properly presented to the operator so that he could detect the treatment frequencies. A meter was used to indicate resonance. The arrangement lacked an electronic motor speed control and therefore the motor speed accuracy was poor primarily because only a voltage control was used and not any form of negative feedback. The vibrator used with this prior method had an output of 2 or 3 inch pounds so that the vibrator in service often had too little force output to accomplish the job.

SUMMARY OF THE INVENTION

The present concept overcomes these prior problems by providing an accelerometer having a resonance substantially outside the frequencies to be studied. By eliminating the use of the meter and instead utilizing a two-dimensional chart recorder which displays and makes graphs of the acceleration versus RPM data and power versus RPM data in such form that resonance is unambiguously and completely displayed for the operator and recorded for purposes of scanning. Extremely close control of motor speed for a predetermined setting is obtained by use of an electronic motor speed control which includes an SCR circuit and a phase lock loop circuit as well as a tachometer which function together to effect very close control of the motor speed. The force output of the vibrator has been increased to more acceptable limits in the range of from six to twelve inch pounds. A DC shunt motor is used with variable voltage with the SCR circuit varying the voltage to the motor. The tachometer senses the motor speed and sends signals to the motor speed control. The phase lock loop circuit compares the motor speed to a signal sent to the motor and varies the signal sent to the motor where necessary.

All of these features distinguish the apparatus and method of the present invention as an improvement over the prior art. The present system provides a power package console which includes more sophisticated filtering of acceleration signals together with an accelerometer that overcomes the deficiencies of the prior method, which was unacceptable because of the resonances it had within the ranges desired, whereas this system has a resonance characteristic on the order of ten times the range to be examined.

This invention utilizes dynamic loading of a workpiece induced by vibration to relieve residual stresses and obtain dimensional stability by achieving yielding, or plastic flow, in the component by applying an external load, in the form of the vibration, that conforms with the direction of the residual stresses and is great enough to combine with some of these stresses to cause yielding or plastic flow which is the key to achieving stress relief. Mere vibration alone is not enough to achieve the stress relief desired, but precisely controlled vibration must be used and this is obtained herein through the use of selected vibration frequencies. This is achieved by fixedly securing a vibrator to the workpiece and attaching an accelerometer to the workpiece in spaced relation to the vibrator.

The apparatus is then activated to scan the workpiece and determine the frequency at which to vibrate which is recorded on a chart. An operator then sets the vibrator at a speed that corresponds to a peak in the acceleration curve. This speed is held until the reaction to the vibrator subsides. The operator then chooses another peak and treats it in a similar manner. Typically, several such peaks throughout the speed range are treated successively until no further reaction results. After such treatment, a new scan is done to document the response change in the workpiece on a chart which becomes a part of the routing sheets for the workpiece.

DESCRIPTION OF THE DRAWINGS

The foregoing and other and more specific purposes of the invention are realized in the vibration stress relieving system illustrated in the accompanying drawings wherein.

DESCRIPTION OF PREFERRED EMBODIMENT

Figure 1:
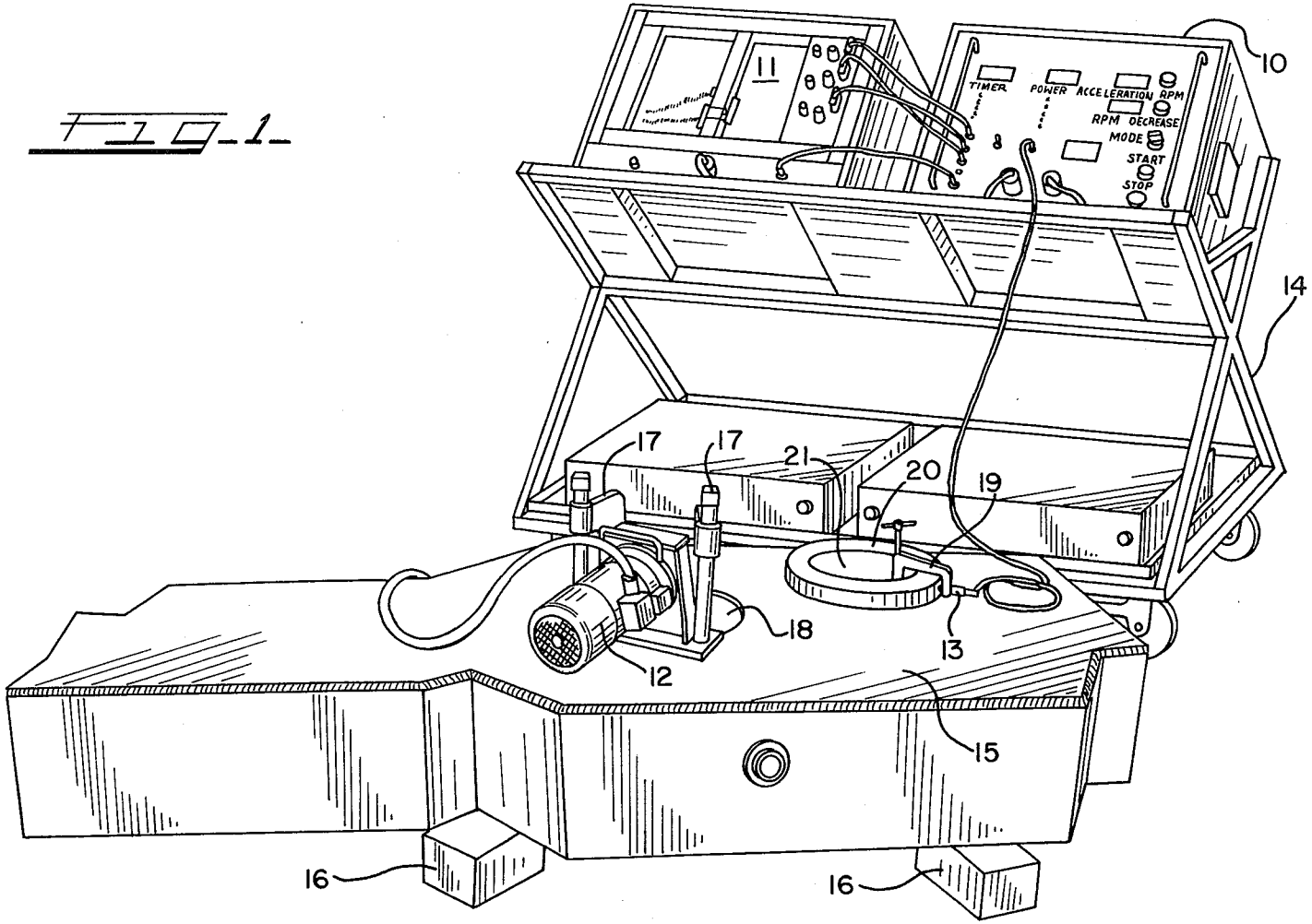
FIG. 1 is a general perspective view of the apparatus for performing this method of vibrational stress relief.
Figure 2:
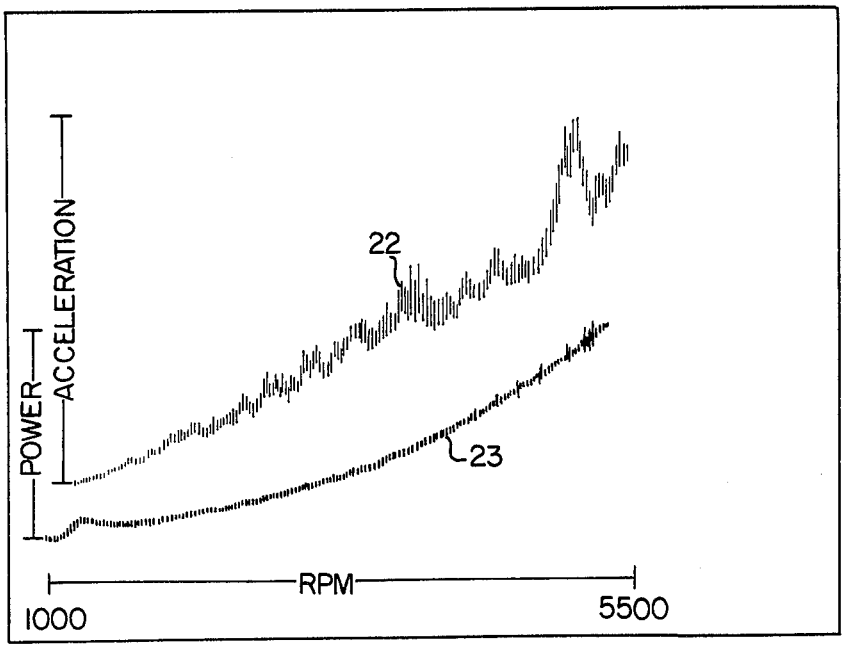
FIG. 2 is an illustration of a chart showing the results of a first scan.
Figure 3:
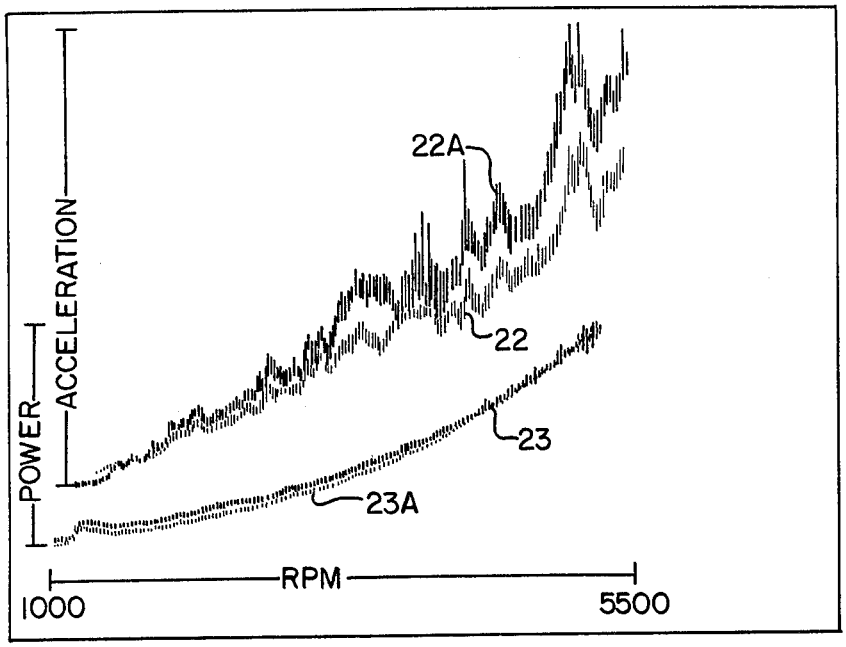
FIG. 3 is an illustration of a chart showing variations between a first and second scanning operation.

As shown in FIG. 1, this apparatus includes four basic elements comprised of a control console 10, a chart recorder 11, one or more vibrator elements 12, and an accelerometer 13, all of which are carried on a wheeled cart 14 that also includes all of the necessary equipment. A workpiece 15 is shown in this Figure and it will be noted that this is isolated from the floor by means of rubber load supporting cushions 16 which enable the workpiece to be vibrated in a freely floating condition.

The control console 10 contains all of the equipment required for this purpose including accurate motor speed controls and an accelerometer amplifier. The control circuitry includes plug-in printed circuit boards so that any problems can easily be resolved merely be replacing a faulty circuit board just by plugging in a new board. Large, easy to read LED readouts give precise readings of vibrator RPM and power, workpiece acceleration and treatment times.

The chart recorder 11 automatically records the scanning data to pinpoint vibrator treatment frequencies as well as the completion of the treatment cycle. The charts, made in two-dimensional form during the treatment process, become a permanent part of the treatment record.

The vibrator 12 is a heavy duty rotary type vibrator device of proven reliability and its force setting weights are adjustable so that the vibrator may be used on large or small workpieces.

The accelerometer 13 provides precise readings as needed for successful treatment of various types of workpieces. The accelerometer is ruggedly built to withstand use in the usual industrial environment and the cable for connecting the accelerometer with the equipment is built to withstand constant vibration without fatigue. Specifically, the accelerometer is designed such that its natural resonance is substantially above the range of frequencies to be sudied by a factor of five or more for example.

With this equipment the invention utilizes controlled vibration to induce dynamic loading of the workpiece, thus relieving residual stresses and thereby obtaining dimensional stability. The invention can be used with very large weldments and with castings as well as forgings. A wide variety of metals may be relieved with this equipment including gray iron, ductile iron, and nodular irons, mild steel, low alloy high strength steels, stainless steels, including martensitic, austenitic and ferritic, heat-treatable alloys and precipitation strengthened metals in the solution-annealed condition, including aluminum, iron, cobalt, and nickel.

In the use of this invention the first step is to isolate the workpiece 15 from the floor, or ground, by means of the rubber load supporting cushions 16 which may be placed under the workpiece at the several corners and with this particular workpiece, under the offset at approximately a mid-position of the one side. In this way the workpiece is completely isolated from the ground and is free to float on the cushions under the activation of the vibrator element 12. The vibrator element, as shown, is rigidly secured to a rigid area of the workpiece. The vibrator is attached by means of clamps 17 which extend through a hole 18 in the workpiece and clamp the vibrator firmly to this rigid section of the workpiece and thereby achieve maximum transmission of the vibrating forces to the workpiece. The accelerometer 13 is secured to the workpiece at a location remote from the attachment of the vibrator 12 and this attachment is secured by means of a clamp 19 that firmly anchors the accelerometer to a collar structure 20 secured about an opening 21 in the top plate of the workpiece.

The system is now ready to be operated and is started by activating the main power switch on the console 10.

The first operation is an automatic scanning of the workpiece to determine a frequency at which to operate the vibrator 12 and this automatic scanning begins at a vibration speed of about 1000 RPM and winds up at about 5000 RPM, which takes about seven and one-half minutes to complete. The chart recorder 11 plots the relative dynamic load as represented by the values of acceleration versus RPM and this is shown as a line curve 22 on the chart. Simultaneously, a recording of vibrator power versus RPM is plotted on the chart by a line 23.

The vibrator element 12 is then tuned to a speed that corresponds with a peak in the acceleration curve 22, but at this time the recording pens do not write during this tuning sequence. The speed associated with the peak is maintained until the reaction to the vibrator 12 subsides and this reaction varies in character, but during a typical reaction, the peak grows in height and shifts to a lower frequency so that it is then located further to the left on the chart. The peaks in the power curve indicate areas where the workpiece may show resistance to the treatment. The reaction terminates in less than fifteen minutes, at which time another peak is chosen and treated in a similar manner. Usually three or four such peaks throughout the speed range are treated until no further reaction results.

After the treatment described, a post-treatment or final automatic scan is done which documents the response change in the workpiece and this becomes a permanent record of the treatment. These curves are shown recorded as 22A and 23A. The variations between the first scan and the second scan clearly indicate the change in dynamic loading response of the work piece 15. Thus, in subsequent operations this record eases duplication or repeatability of the treatment and facilitates supervision inasmuch as the treatment charts become part of the routing sheets for the workpiece.

This system operates on standard 110 volt or 220 volt current and consumes relatively little power when compared to the enormous amount of energy represented by fuel or electricity consumed by previous methods such as thermal stress relieving furnaces. The present system can be used on very large workpieces including those too large for such an oven.

This system is portable whereby it can be brought to the workpiece instead of the other way around of transporting it to an oven, or to an outside heat treater which consumes considerable time and expense and also requires adaptation to the work schedule of whoever may handle the work. The present treatment affords the great advantage of consuming very little time which may approximate one hour total with no time required for a cool down period. The system can relieve stress in internal workpiece members as well as work pieces having varying wall thicknesses without creating additional stresses that could be caused by non-uniform heating and cooling as in a thermal stress relieving method.

CONCLUSION

From the foregoing it will be seen that there has been provided an apparatus and method for vibrational stress relief wherein controlled low amplitude, low frequency vibrations are applied to a workpiece component to obtain dimensional stability by lowering the residual stresses in the workpiece without reducing the yield strength or the fatigue life of the component and which will not strain harden the material.

What is claimed is:

1. A method for stress relieving a workpiece by vibration comprising the steps of conducting a pretreatment scan by vibrating the workpiece through a range of predetermined frequencies which range is lower than the natural resonance of the accelerometer by a factor of five or more and recording in two-dimensional form the acceleration of the workpiece as a function of vibrator RPM whereby discernable resonant peaks of the workpiece are displayed, treating the workpiece by vibrating it at the frequency of a plurality of resonant peaks and maintaining the frequency of vibration which excites respective resonant peaks while the amplitude of the peaks increases and/or the frequency of the resonant peaks decreases, and conducting a post-treatment scan by vibrating the workpiece through the same range of frequencies as in the pretreatment scan and utilizing a recorder for recording in two-dimensional form the acceleration of the workpiece as a function of RPM of the vibration to enable ascertainment and comparison of changes in the dynamic loading response as a result of the treatment of the workpiece recorded on a graph displayed by the recorder, and recording in two-dimensional form a plot of the vibrator power as a function of RPM simultaneously with and on the same chart as the acceleration as a function of RPM.

2. An apparatus for stress relieving a workpiece including a rotary eccentric weight vibrator, a variable speed electric motor drivably connected to said vibrator, an electronic motor speed control, a control console adapted to display vibrator RPM, vibrator power, workpiece acceleration and treatment time, an accelerometer physically connectable to a workpiece to be treated and connected to the control console to transmit to the console the acceleration of the workpiece, a chart recorder connected to the control console to simultaneously record, in two-dimensional form, the acceleration of the workpiece as a function of vibrator RPM as one curve and vibrator power as a function of vibrator RPM as another curve, the natural frequency of said accelerometer being above the range of frequencies at which the workpiece responds.

* * * * *